US006502254B1

(12) United States Patent
De Menna

(10) Patent No.: US 6,502,254 B1
(45) Date of Patent: Jan. 7, 2003

(54) VANITY WITH ACCESSIBILITY FEATURES

(75) Inventor: Quinn Anthony De Menna, Haddon Heights, NJ (US)

(73) Assignee: Ewing Cole Cherry Brott, Inc., Philadelphia, PA (US)

( * ) Notice: Subject to any disclaimer, the term of this patent is extended or adjusted under 35 U.S.C. 154(b) by 0 days.

(21) Appl. No.: 09/693,762

(22) Filed: Oct. 20, 2000

Related U.S. Application Data

(60) Provisional application No. 60/161,236, filed on Oct. 22, 1999.

(51) Int. Cl.[7] ..... A47K 3/022

(52) U.S. Cl. ..... 4/621; 4/630; 4/631; 108/25; 312/228

(58) Field of Search ..... 4/615, 621, 630, 4/631, 638, 571.1, 561.1, 576.1, 560.1, 577.1, 663, 664; 312/140.1, 140.3, 194, 228, 239, 228.1; 108/25, 27, 42, 90

(56) References Cited

U.S. PATENT DOCUMENTS

| | | | | | |
|---|---|---|---|---|---|
| 2,060,855 | A | * | 11/1936 | Davock | |
| 2,079,410 | A | * | 5/1937 | James et al. | 4/577.1 |
| 2,141,347 | A | * | 12/1938 | Davis | |
| 2,815,513 | A | | 12/1957 | Tilson et al. | 4/185 |
| 3,018,490 | A | | 1/1962 | Eichorst | 4/170 |
| 3,915,529 | A | * | 10/1975 | Bernier | 312/237 |
| D251,256 | S | | 3/1979 | Newburger | D23/48 |
| D261,028 | S | * | 9/1981 | Bitvai | D23/38 |
| 4,799,743 | A | * | 1/1989 | Kikuchi et al. | 312/228 |
| 4,854,652 | A | * | 8/1989 | Ahmann | 312/140.2 |
| 4,899,402 | A | * | 2/1990 | Maynard et al. | 4/663 |
| D317,198 | S | * | 5/1991 | Gocke et al. | D23/290 |
| 5,065,462 | A | * | 11/1991 | Romano | 4/604 |
| 5,230,109 | A | * | 7/1993 | Zaccai et al. | 4/645 |
| D352,992 | S | | 11/1994 | Pajetta | D23/271 |
| D353,882 | S | | 12/1994 | Buzby | D23/271 |
| 5,465,438 | A | | 11/1995 | Allman et al. | 4/626 |
| 5,561,871 | A | | 10/1996 | Laughton | 4/619 |
| 5,566,404 | A | | 10/1996 | Laughton | 4/619 |
| D378,173 | S | * | 2/1997 | Hobson | D6/421 |
| 5,628,075 | A | * | 5/1997 | Dudnik et al. | 4/645 |
| 5,664,852 | A | | 9/1997 | Robinson | 312/228 |
| 5,715,547 | A | * | 2/1998 | Becker et al. | 4/619 |
| 6,213,575 | B1 | * | 4/2001 | Brin, Jr. et al. | 312/140.1 |
| D444,216 | S | * | 6/2001 | Katz et al. | D23/284 |

* cited by examiner

*Primary Examiner*—Gregory Huson
*Assistant Examiner*—Huyen Le
(74) *Attorney, Agent, or Firm*—Duane Morris LLP

(57) ABSTRACT

A wheelchair accessible vanity panel has a panel that is cantilevered at a space over a floor or other surface, and has a free edge along a side or along a curve or angle extending around two or more sides. The cantilevered panel leaves a free space over a vertical height that preferably is dimensioned to admit the lower part of a wheelchair or can be used with a stationary-type chair. A hand grip is formed integrally with the horizontal panel, the grip being defined by at least one strip along the free edge of the panel subdivided from the free edge by a slot extending for a distance along the free edge. The handgrip is durably and attractively integral with the panel and provides a readily and securely grasped part of the panel by which the user of a wheelchair can displace the chair toward or away from the panel and the work surface it defines. Preferably the hand grip is provided by laminating multiple thicknesses, forming a slot and rounding over the edges of the slot and the free edges of the panel.

15 Claims, 7 Drawing Sheets

VANITY WITH ACCESSIBILITY FEATURES

This application claims the benefit of provisional application No. 60/161,236 filed Oct. 22, 1999.

BACKGROUND OF THE INVENTION

1. Field of the Invention

The invention relates to countertops structured for accessibility to persons using wheelchairs and the like. In particular, a countertop for mounting a sink or basin is cantilevered so as to provide leg space under the countertop, and has one or more hand grips formed by a slot provided at a space from a free edge of the countertop, preferably running parallel to the front edge.

2. Prior Art

One or more basins or sinks are often mounted in countertops found in lavatories, kitchens and similar settings. Particularly in a lavatory or bathroom, such a combination of a sink and countertop is sometimes known as a "vanity." The conventional structure of a sink installation of this type comprises a flanged basin that rests in an opening in a horizontal panel functioning as the countertop. The countertop is generally relatively thick, e.g., 2 to 4 cm., and can be made of stone (e.g., marble or granite) or simulated stone product, and can be solid or laminated. A variety of materials are available which can receive or be combined with attachable basins, integral basins, backsplashes, bull noses and other features.

Such a countertop is typically supported on a cabinet having walls or doors that extend vertically downward from a point flush with the lateral edge of the countertop or leaving only a slight overhang. This structure presents accessibility problems for wheelchair occupants.

A wheelchair user normally is disposed in an upright sitting posture. There is generally a forward right angle between the back and the thighs (femurs) and a downward right angle between the thighs and shins (tibias), with the result being that the user's knees are placed a substantial distance (e.g., 50 cm.) forward of the shoulders. If the user approaches the vanity directly from the front, the user's feet and/or knees abut the cabinet walls or doors of the vanity when the user's back and shoulders are at a distance from the front edge of the counter. Thus to reach the faucet or other controls, which often are at the back of the basin, the user must reach well forward past his or her knees, and over the front edge of the countertop. The alternative is to align the wheelchair to face parallel to the front edge of the counter. In that case the user must access the sink over one of the armrests of the wheelchair, which is awkward and uncomfortable.

It is known to improve the wheelchair accessibility of a sink or basin as described, by clearing a space under the countertop. This permits a wheelchair user to roll his/her lower extremities beyond and under the front edge of the countertop, bringing the basin and any faucets or similar controls more within reach when approaching directly from the front.

Examples of wheelchair accessible sink and vanity arrangements are shown, for example, in U.S. Pat. No. 5,664,852—Robinson, U.S. Pat. No. 5,566,404—Laughton and U.S. Pat. No. 5,561,871—Laughton, which are hereby incorporated for their teachings of wheelchair accessible structures in which the chair user rolls part way under the countertop. These references also employ faucets placed at the side rather than the rear of the sink. In Robinson, the space under the sink is cleared by rotating a cabinet structure clear of the space under the countertop. This can be accomplished using handrails that protrude from the structures under the countertop at strategic locations such as the rear side of a pivotable door structure.

Typically a wheelchair user who seeks to pull the front of the chair under a counter or to push away from a counter, simply grasps the front edge of the counter. Insofar as the typical counter structure contains a rail extending laterally along the front of the vanity, the rail is typically associated with a towel rack. Such a towel rack generally comprises a laterally extending rail that is turned 90 degrees toward the vanity at its ends, and affixed to a front facing surface of the vanity on escutcheons that are screwed or similarly attached to the vanity. The usual towel rack is only provided with sufficient structure to support the vertical weight of a wet towel, and is not meant to provide a hand hold for pulling upon or pushing against as a means to move a wheelchair relative to the vanity.

Elderly persons as well as persons using wheelchairs may find it difficult to pull themselves up to a sink or to support themselves adequately at the sink. Typically such persons grasp the edge of the sink. Alternatively, and perhaps more dangerously, such persons may attempt to grasp the faucet or the water control valves. These may be located relatively inaccessibly at the rear of the sink, or may be placed at the side. The faucet and valves, however, are not intended to be used as manual grasping points, and over time can become loosened, causing water leaks, or may break due to metal fatigue.

It would be advantageous if the known vanity structure could be improved to provide a more durable form of edge rail that is sufficiently robust to provide a push/pull grasping point against which a wheelchair user can exert a force to move the wheelchair relative to the vanity in a manner apt for bringing the user into manual reach of the basin and the controls, or permitting a smooth disengagement after use. Preferably, this is done without producing forward protrusions or other obstructions that the user can inadvertently rap with his knees or elbows or the like. According to the present invention, these objects are met in an arrangement that is very durable, attractive and easily cleaned. In particular, rails are formed integrally in the front edge of a countertop by forming a slot that is slightly wider than the user's fingers and is spaced from the front edge by a distance that causes the forward edge of the countertop to form a thick and durable rail that is readily grasped, or can function to hold a towel or the like.

SUMMARY OF THE INVENTION

It is an object of the invention to provide an improved vanity work surface that is accessibly mounted to define an access space under a panel defining the work surface, wherein the panel has an accessible edge formed into a grab bar.

Inasmuch as the grab bar as described is an integral part of the panel structure, it is much more durably and intimately attached to the work surface panel than is possible using an attached structure. Furthermore, the grab bar of the invention does not form a protrusion and thus is not subject to uncomfortable impacts with body parts.

The integral grab bar panel preferably has a series of slot lengths separated by areas at which the work surface panel extends integrally to the edge of the panel. These slots can be generally evenly spaced around the available periphery of the panel, and used as desired by a particular user. In addition, one or more of the slots that subdivide the grab bar from the remainder of the panel, and the associated grab bar, can double as a towel bar.

The grab bar structure is readily formed in the same manner that outside edges are formed on the panel, for example by providing spaced bores joined by cuts made with a band saw or saber saw, and rounding over the associated edges. This provides and attractive and comfortably smooth arrangement that is applicable to solid panel materials, laminates or the like.

The invention is particularly applicable to a vanity arrangement for assisted living residences and residences for elderly persons. For this purpose, a bathroom sink or vanity product advantageously is integrated and standardized in one or a few variations that are applicable to various installations with minimal customization and cabinetry work. These variations can include customer choices and in any event should be attractive, functional and modest in cost. The vanity or sink product should make the facility optimally useful and accessible to typical residents, should be safe, and thus will promote the independence of the resident in performing bathroom activities.

More particularly, from the residents' standpoint, the product should be fully functional for all traditional lavatory activities. It should be arranged to minimize the danger of falls. It should be easy to use and also should be perceived as easy to use rather than as awkward or as requiring special preparations or added tasks. In this way the product is functionally useful and also contributes to the residents' independence and self esteem.

From the standpoint of the care provider, the product should decrease reliance on caregiver assistance. Advantageously, the product should be noninstitutional in character, namely including decorative and comfort-enhancing features and being customized to the user's option. The product also should be cost-effective, namely easily and inexpensively procured, installed and maintained.

The foregoing aspects and objects thus are provided by an article of manufacture as described and also by the inventive method. In particular, the invention is particularly applicable for use as a wheelchair accessible vanity panel with a top surface, such as a work surface or a surface in which a basin and possibly hot/cold water valve controls and a faucet are disposed. The panel has at least one free edge, which may be along one side or on a curve or angle extending around two or more sides. The panel is mounted at a space from an underlying surface, leaving clear a lateral space and vertical height that preferably is dimensioned to admit the lower part of a wheelchair. A hand grip is formed integrally with the horizontal panel, the grip being defined by at least one strip along the free edge of the panel subdivided from the free edge by a slot extending for a distance along the free edge. The handgrip is durably and attractively integral with the panel and provides a readily and securely grasped part of the panel by which the user of a wheelchair can displace the chair toward or away from the panel and the work surface it defines.

Needs of seniors and assisted-living residents are sometimes accommodated by adding an assemblage of products or modifications to standard products. An example is attaching a grab bar to a countertop. Components of a sink or vanity installation, such as a grab bar, top and attachment devices, preferably are integrated and integral. This reduces the time and attention required for installation, and integral structures are typically substantially stronger and more durable than assembled parts.

A sink or vanity arrangement may advantageously be constructed in a similar standardized way for all or many of the residential units in a building. However, it is possible that some of the standardized aspects may be primarily used only by certain residents. Such aspects should be fully adapted for the assistance of those that need them, and should not render the product inconvenient for those that do not need them. For particular installations and particular users, for example, consideration must be given to the ability of possibly frail residents to maneuver a wheelchair into the accessible sink area, the ability to pull up to the sink or perhaps to stand from a wheelchair, the ability to steady or balance oneself moving about in the bathroom, and so forth. Flat countertop surfaces may be ineffective for balancing or grasping to support or steady oneself. This may reduce the resident's ability to reach or operate the controls or other areas of the work area, both directly and by reducing the residents' confidence. It is unsafe or otherwise inappropriate for the resident to rely on some possible support choices that are not structured as such, for example screwed-on towel bars, a movable drawer, a faucet structured for plumbing rather than as supports, etc.

BRIEF DESCRIPTION OF THE DRAWINGS

There are shown in the drawings certain embodiments of the invention as presently preferred. It should be understood that the invention is not limited to the precise arrangements and instrumentalities shown in the drawings, wherein the same reference numbers refer to the same parts in the respective views, and wherein.

DETAILED DESCRIPTION OF THE PREFERRED EMBODIMENTS

Figure 1:
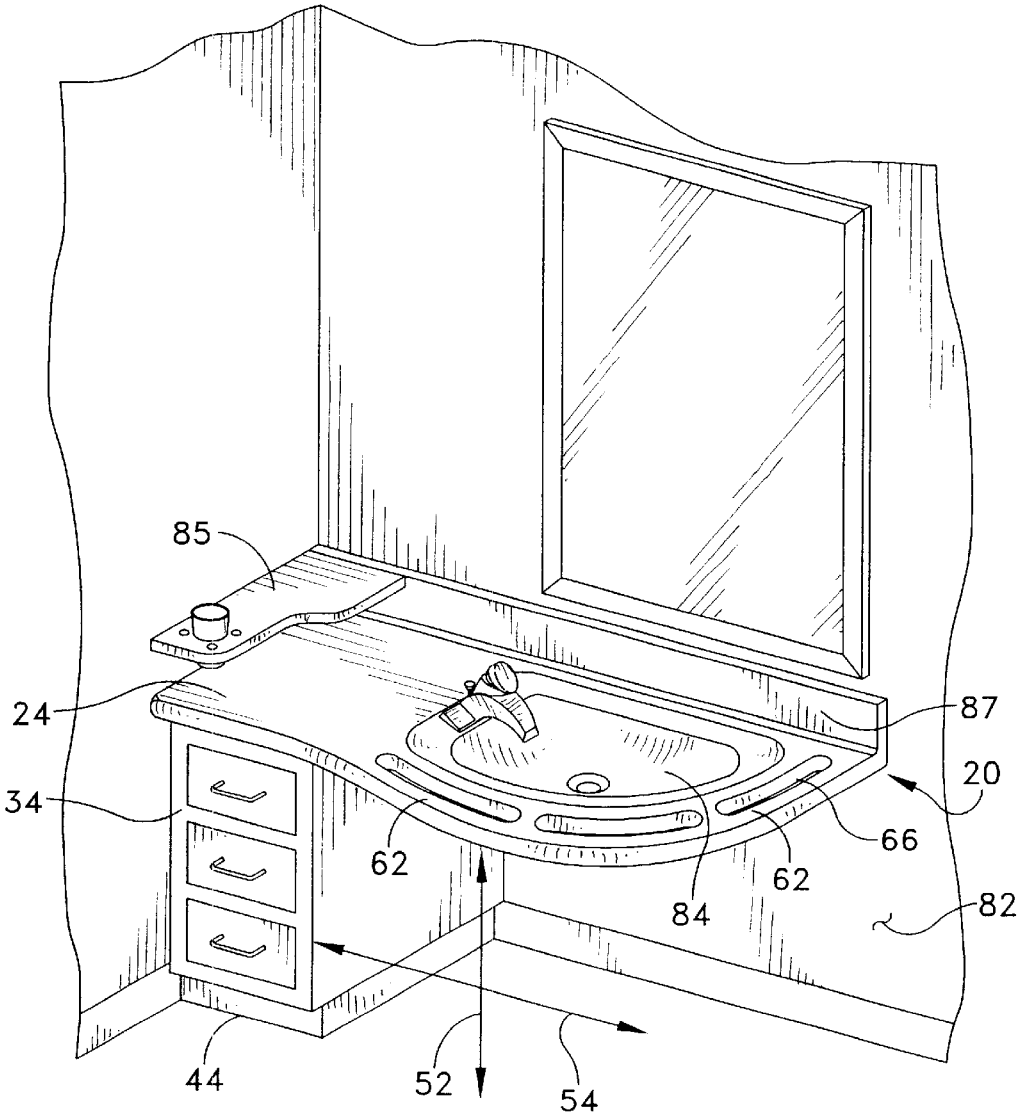
FIG. 1 is a perspective illustration of a wheelchair accessible work surface according to one embodiment of the invention, shown installed.
Figure 2:
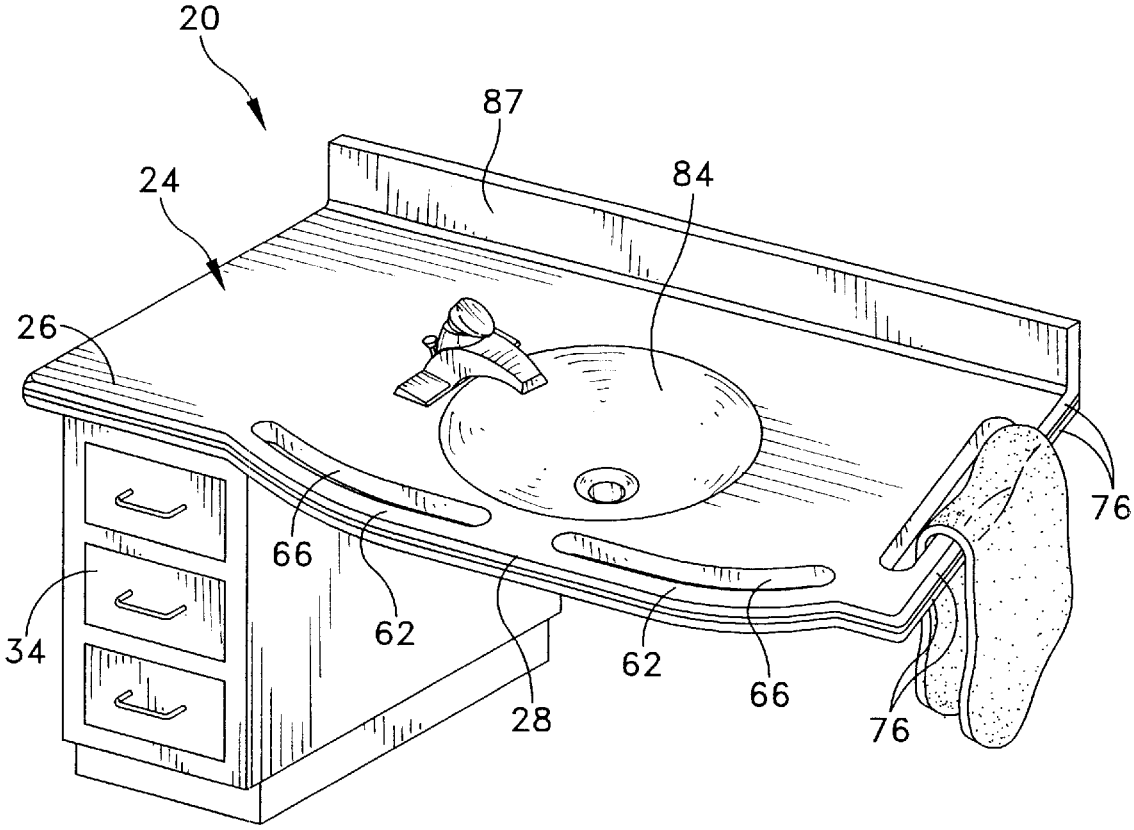
FIG. 2 is a perspective illustration showing an alternative embodiment thereof.
Figure 3:
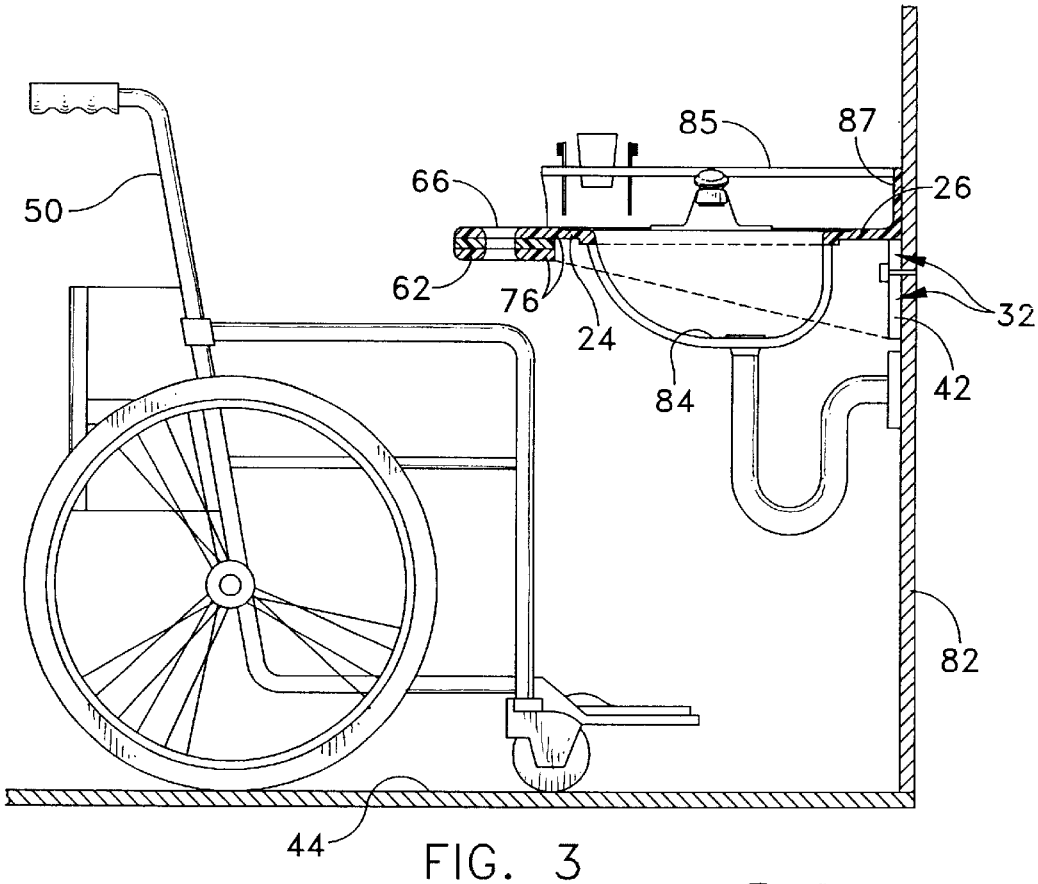
FIG. 3 is an elevation view, partly in section, illustrating certain construction aspects of the work surface.

Referring to FIG. 1, a work surface 20 according to the invention is shown installed in a room. In FIG. 2, an alternative embodiment is shown apart from structural components of the room. The invention provides a vanity table, preferably holding a sink or basin, mounted and configured to permit access by elderly persons and people in wheelchairs (see also FIG. 3). Specifically, a panel 24 defining a work surface is mounted so as to have a clear area under a work or top surface 26 with a height 52 and lateral width 54, permitting users who may need to or wish to use a chair, to bring the chair up to the work surface and/or to place the chair in a way that positions part of the chair and possibly part of the user's body under the work surface. This arrangement is particularly applicable to providing access to a user of a wheelchair 50, which can be brought part way under the panel 24 as shown in FIG. 3.

Referring to FIGS. 1 and 2, the work surface 20 generally comprises a panel 24 having a top surface 26 and at least one free edge 28. In the embodiments shown in FIGS. 1 and 2, a free edge 28 is provided along a portion of the front of the work surface and along its right side. It would be possible to provide a similar arrangement in which only the front edge is free (e.g., with the work surface extending between two columns), or perhaps wherein the work surface is supported centrally on a pedestal such that the free edge 28 extends all the way around a perimeter of the panel.

The work surface is carried on a mounting 32 that supports the horizontal panel of the work surface at a space 52 above an underlying surface (i.e., the floor) and leaves unoccupied a lateral area 54 between the underlying surface and an underside of the horizontal panel, at least over a width sufficient for the user to place part of a chair 50 under the free edge 28.

In the arrangement shown, the horizontal work surface panel is carried at one end on a cabinet 34 that rests on the floor 44. The work surface panel is cantilevered laterally (to the right) from the cabinet 34, thereby leaving the space under the panel.

According to an inventive aspect, at least one hand grip or grab bar 62 is formed integrally with the horizontal panel 24. As shown in FIGS. 1 and 2, the grip is defined by at least one strip along the free edge 28. The strip or hand grip 62 is subdivided from the work surface panel by a slot 66 spaced inwardly from the free edge 28 and extending for a distance along the free edge.

The hand grip 62 comprises a laterally elongated bar that is integral with the work surface panel 24 and extends along the free edge 28. The hand grip bar is preferably round, oval or similarly smooth in contour for easy grasping. The slot 66 that subdivides the grip bar from the panel has a width exceeding a width of a user's fingers. For example, the slot can be about 1.5 inches (3.3 cm) in width and can open about 1.25 inches (2.7 cm) from the free edge. The opposite walls of the slot are rounded over by radius cuts, chamfers or the like, such that the remaining hand grip portion along the free edge of the work surface has a rounded cross section.

In the embodiments shown in FIGS. 1 and 2, the slot extends completely through the width of the work surface panel 24 over the full lateral distance of each of a plurality of lengths of slots 66 defining several serially spaced hand grips 62 along the free edge 28. It is also possible to have the slots extend only part way through the work surface panel (not shown) rather than completely through. Provided that the width of the work surface panel is less at the slot than at a position closer to the free edge, the result is an elongated hand grip. Preferably, however, the slot extends completely through the panel as shown, permitting the user to extend his or her fingers through the slot and wrap them around the hand grip.

In the embodiment shown in FIGS. 1 and 2, two slots 66 and corresponding hand grips 62 are provided at the front edge of the work surface, in the direction that the user normally approaches to use the sink or basin, and another is provided at the right side. In this arrangement the work surface panel is cantilevered and is supported by cabinet 34 under the work surface only on one side. In this arrangement, it is advantageous to provide at least one additional slot and hand grip oriented toward the right in the figures, namely at the free edge at the right side. FIG. 2 shows that this side or end hand grip can double as a towel rack.

In FIG. 1, the work surface panel is substantially all the same thickness. This thickness can be built up of laminated layers 76 of material as shown in FIG. 2, such as durable surface layers of simulated stone laminated on wood or other materials. A sink or basin 84 can be attached under the work surface and can be a contrasting or matching material. In a known construction technique used for matching basins, it is possible to place a transition rim around a hole cut in the panel 24 for the basin, and to rout or otherwise smoothly round over the rim material to proceed flush from the panel surface to the basin surface.

FIG. 3 illustrates a preferred n embodiment in which the work surface panel is made thicker at the front edge than over the remainder of its width using laminated layers. The thickness is increased at the front edge by laminating material additional material thickness at the front edge as compared to the rest of the panel 24. The added thickness can be provided in a fraction of the thickness of the remainder panel and/or only from the front edge 28 up to the slot 66. In FIG. 3, however, a full double thickness is provided by lamination layers 76 extending from the front edge 28 to a point several inches beyond the slot 66. This arrangement is advantageous because the added thickness stiffens the cantilevered panel structure, and a relatively large diameter hand grip 62 is provided, for example about 3 cm in diameter.

In addition to the laminated additional thickness at the free edge 28, FIG. 3 shows how the vanity or work surface panel 24 is mounted relative to the room floor 44 and the adjoining wall 82 of the room, and also shows how a wheelchair 50 can approach the work surface far enough that part of the wheelchair (and the user thereon) can extend beyond the free edge 28. As discussed above, the work surface 24 is carried on a cabinet 34 at one end, that extends between the underside of the work surface panel 24 and the floor 44, thus supporting the panel at one end (the left in FIGS. 1 and 2). The panel 24 preferably abuts against a room wall 82, and a ledger strip 42 is attached securely to the wall 82 to provide vertical support as shown sectionally in FIG. 3. The supply and waste pipe connections to the basin 84 and to the associated hot/cold mixing valves are preferably kept relatively high as shown in FIG. 3. Alternatively or in addition, the pipe connections can be routed through the cabinet 34 or along the surface of the cabinet over a part of their extension.

The work surface 20 can contain other appurtenances that are apt for sink or basin installations. For example, in the embodiment shown in FIGS. 1 and 3, a shelf 85 is provided along one side for supporting a toothbrush holder, cup support, soap dish or the like. It is often advantageous to contour the surface of a sink or basin panel 24 such that the elevation is slightly higher proceeding away from the basin so as to drain water back into the basin from the surface. It is also advantageous to provide a raised backsplash strip 87 as shown. These and other arrangements for sink and basin installations are apt for use with the invention.

The invention is illustrated with respect to a basin or sink arrangement, i.e., a wet facility, but is also applicable to flat work surface vanities, to dry sinks and other particular uses.

Figure 4:
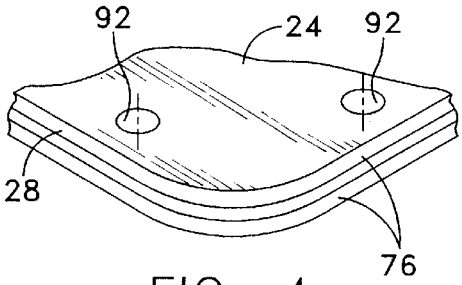
FIGS. 4, 5 and 6 are partial perspective views schematically showing forming hand grabs in a laminated panel material according to the invention.
Figure 5:
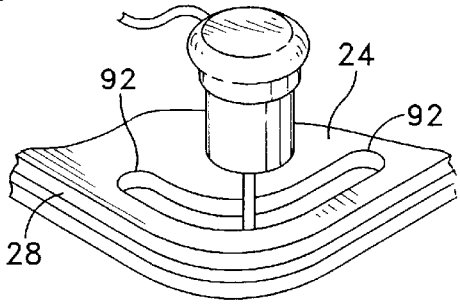
Figure 6:
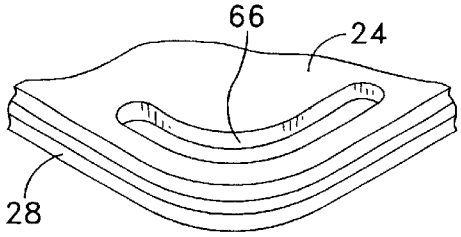
Figure 7:
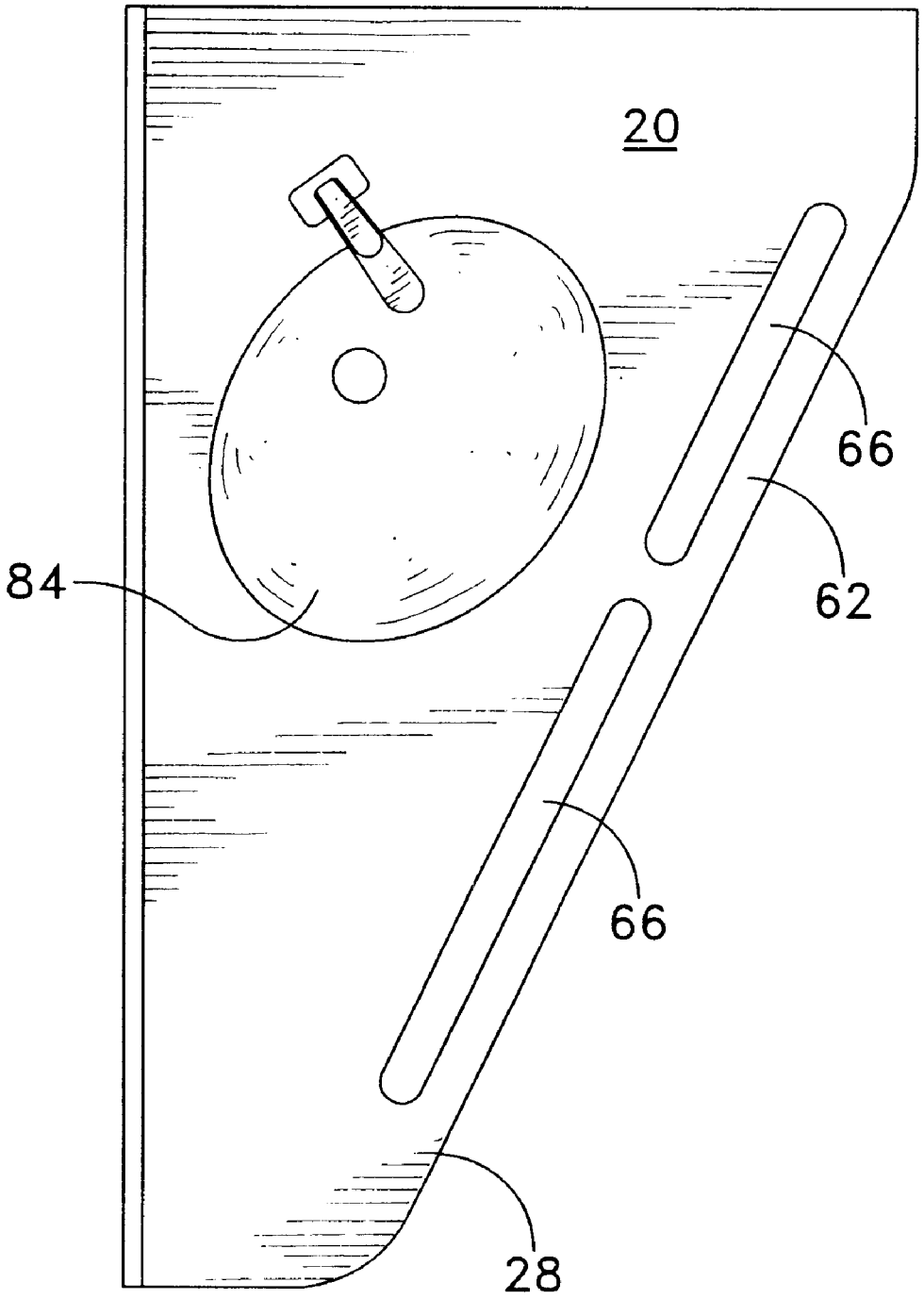
FIG. 7 is a plan view illustrating a corner-mounted embodiment.
Figure 8:
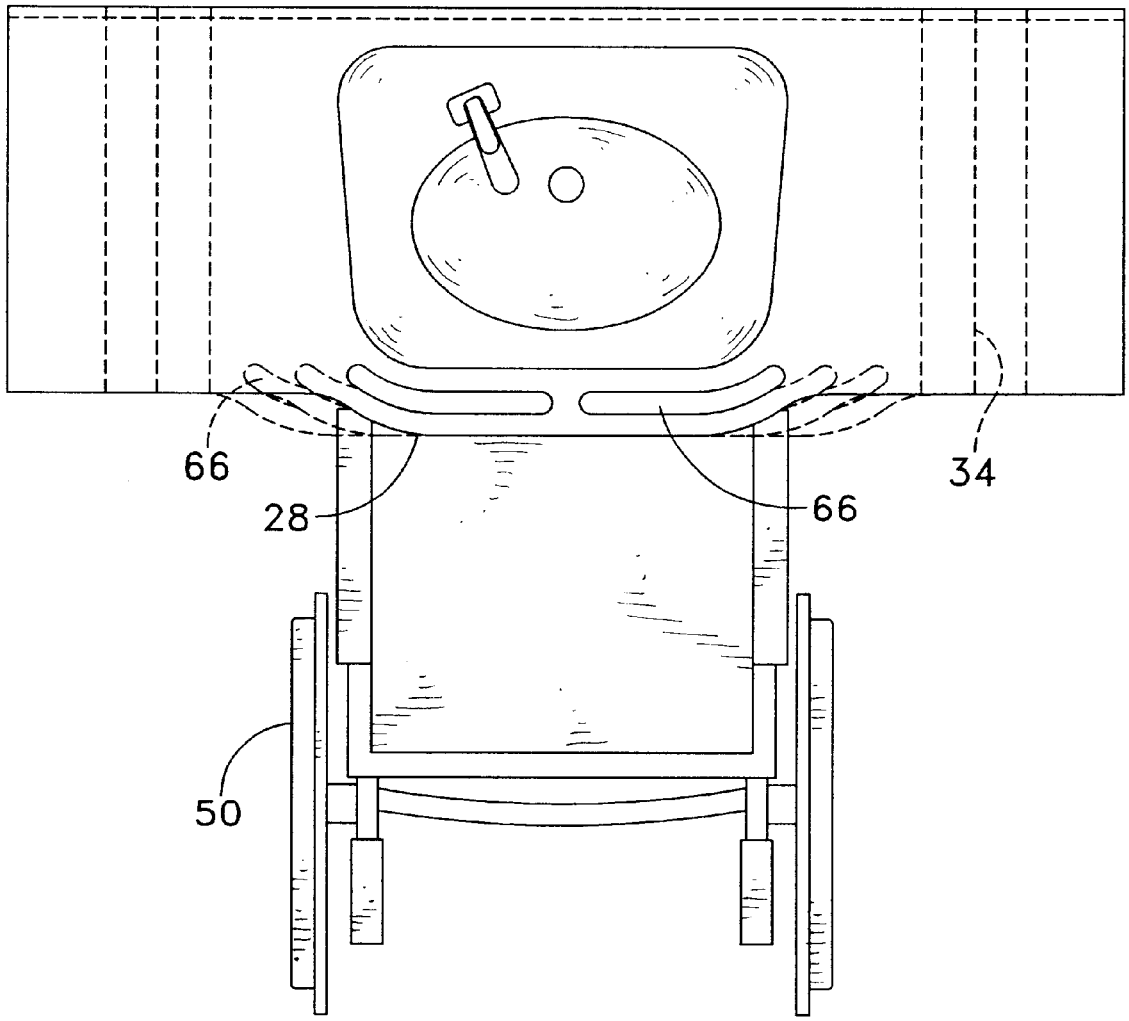
FIGS. 8 and 9 are plan views illustrating alternative embodiments and including illustration of wheelchair approach.

FIGS. 1–3 illustrate a number of structural aspects of the invention and also show certain method steps that are involved. FIGS. 4–6 also illustrate some construction details. Generally, according to the invention a panel 24 is provided, dimensioned to encompass a work surface having a lateral area bounded by an edge 28. A slot 66 is formed in the panel, for example as shown in FIGS. 1–3. The slot 66 is spaced from the free edge 28 of the panel 24, thereby defining a graspable elongated grip structure 62 between the slot 66 and the edge 28. The panel is mounted at a space 52 above an underlying surface, whereby a space under the panel 24 is free for access over at least part of the lateral area encompassed by the panel, and can admit part of a chair such as a wheelchair 50 or the like, which is brought up to approach the work surface and to pass under a panel edge 28 into the space under the panel.

A user of the work surface, and in particular a wheelchair occupant, can grasp the grab bar 62 defined between the slot 66 and the edge 28 of the panel 24. By exerting a force on the panel in this way, the user can manually manipulate a wheelchair 50 or similar conveyance relative to the work surface, or simply can steady himself or herself when standing to use the work surface and/or sink or basin 84.

FIGS. 4–6 illustrate an exemplary method for forming the hand grip and panel structure. In FIG. 4, a second thickness 76 is attached to the work surface panel 24 from below, for example doubling the thickness by lamination. The added thickness can be attached, for example, using adhesives or fasteners. To form the slots 66 that subdivide the panel 24 so as to provide a grab bar 62, holes 92 can be bored at a distance from one another along the edge of the panel 24.

In FIG. 5, a slot 66 is formed by cutting out the material between the spaced holes 92, thus providing a slot that has rather sharp edge contours. In FIG. 6, the edges of the slot 66, and preferably also the free edges 28 of the panel 24, are rounded over. As also shown in FIG. 3, this provides a grab bar 62 that is substantially round or similarly rounded in cross section, which is both strong and comfortable to grasp.

The invention as described can readily be embodied in a manner that meets or exceeds many of the accessibility requirements of the ADA and similar regulations. In addition to providing access where special structural aspects are necessary, the invention improves the usefulness of the sink or vanity to persons who may be capable but are frail or weak in certain aspects of physical strength.

Preferably, the product is easily and inexpensively constructed, relying on lamination of lightweight sheets, preferably with 100% acrylic solid structures or at least surface layers, which can be shaped using computer-controlled router machining. An advantageous material is solid-surface DuPont Corian® material, which provides a seamless, nonporous surface and good structural rigidity.

Notwithstanding the standardized aspects, the invention is also readily customized if desired. For example, the faucets can be located at 10 or 2 o'clock for easier reach. The basin size or shape can be subject to choice. The particular solid surface material likewise can be standard or subject to choices of type, color, fabrication details and the like.

The preferred embodiment shown uses a standard J. R. Smith lavatory carrier and cabinet for cantilever support. It can be supplied in the field as a complete"boxed" set comprising the top, bowl or basin, carriers and associated hardware. Thus, installation is similar to that of a standard wall-carried lavatory.

However, the standardized wall-mounted layout as shown provides for wheelchair maneuverable access. The integral grab bar provides a secure means of pulling up to or standing at the sink. An arrangement with a countertop cantilevered from one end (rather than supported at both ends, which also is possible), gives an approach space that is substantially wider than the standard 30 inches, and is also not as limited as to direction of approach, for example permitting a swing maneuver in the approach of a wheelchair.

Figure 9:
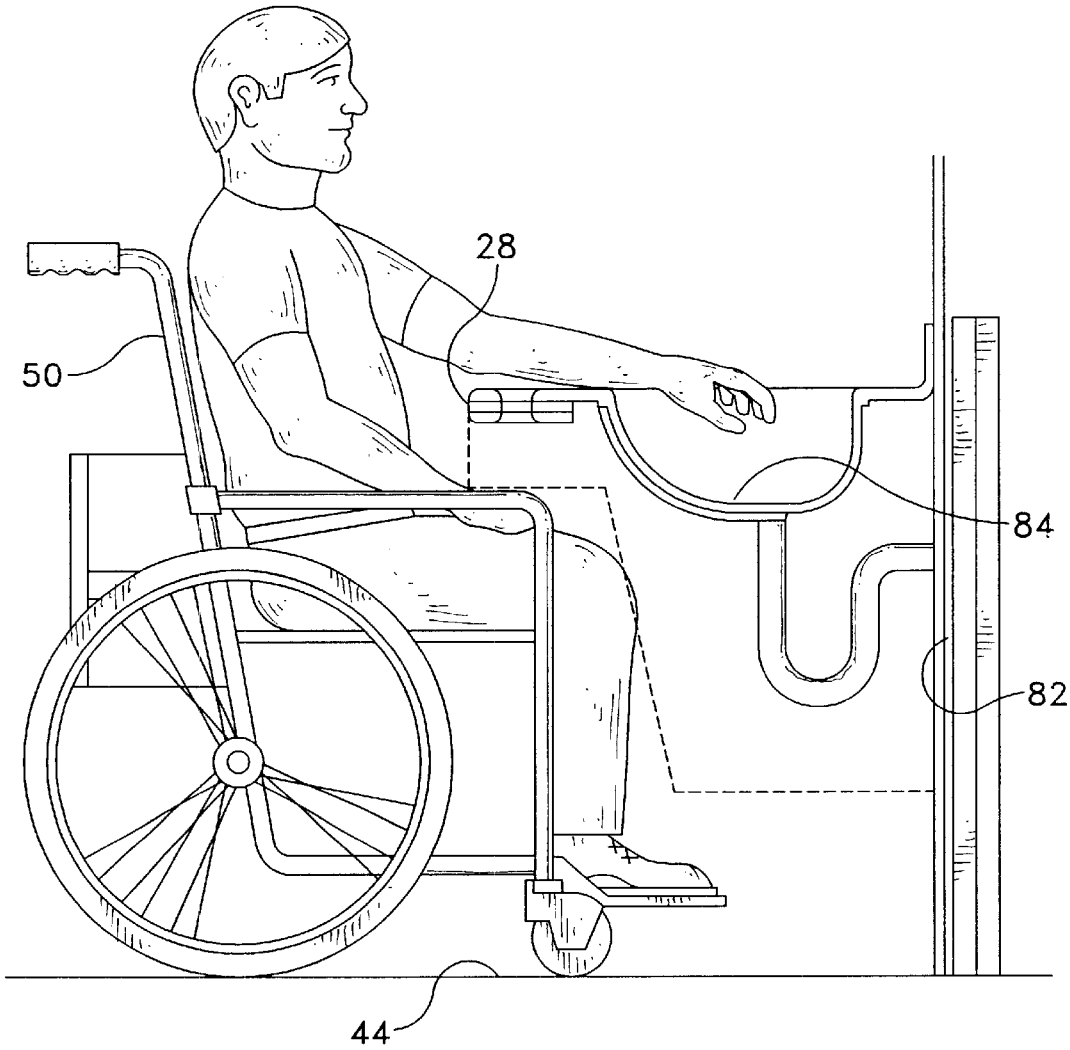

FIGS. 7 through 11 illustrate a number of specific embodiments adapted for uses including a corner mounting (FIG. 7), work surfaces supplied in a range of optional sizes (FIG. 8), which are optionally cantilevered from either side or supported by cabinets (not shown) at both sides. FIG. 9 illustrates a left-handed version of the embodiment of FIG. 1.

Figure 10:
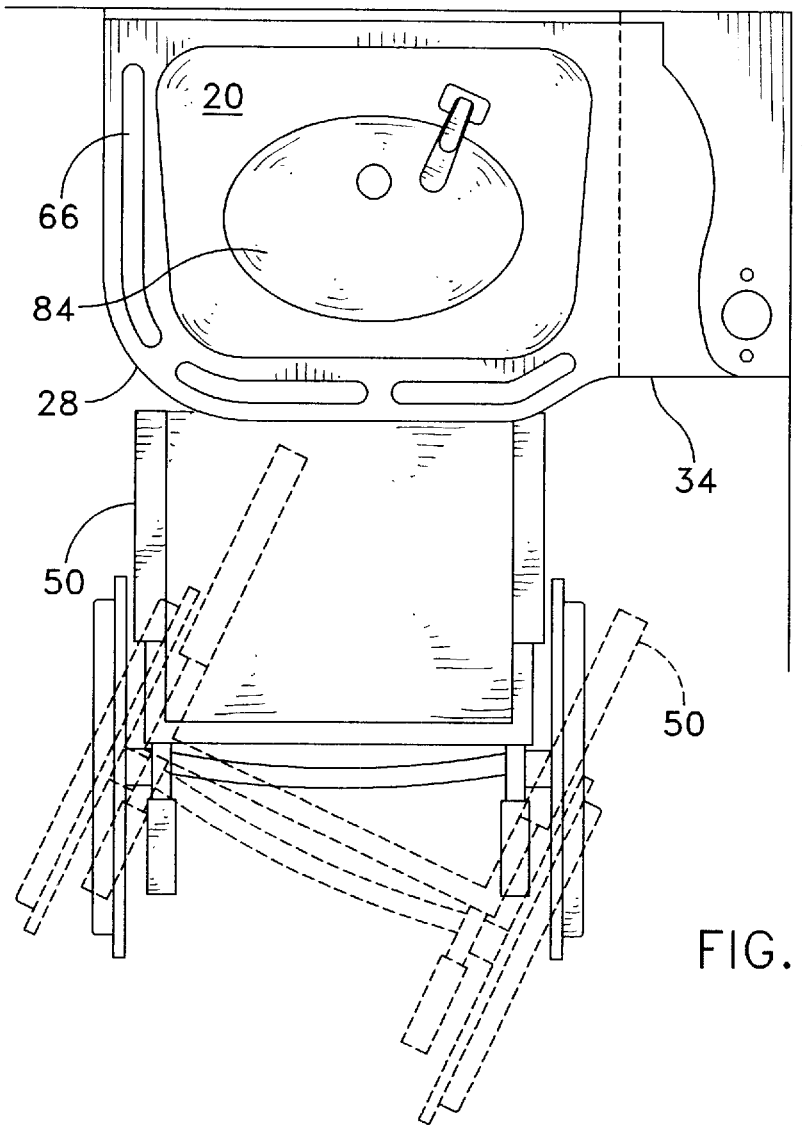
FIG. 10 is an elevation view, partly in section, showing an alternative embodiment with a sink wall carrier structure and showing wheelchair approach.

FIG. 10 is a sectional elevation view showing certain dimensions in conjunction with a typical wheelchair size, and the plan view in FIG. 9 also shows the space needed to effect an angular approach or to rotate the chair into position in front of the vanity and includes dimensions in plan view.

Figure 11:
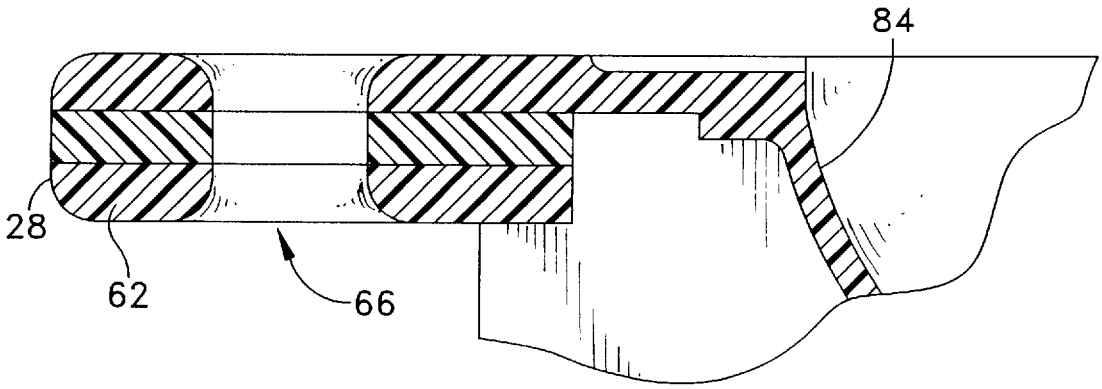
FIG. 11 is a partial section view showing a preferred arraignment in which the grab bar is laminated of three material thicknesses, and showing a recessed deck contour surrounding an integrally joined sink or basin.

As discussed above, it is an aspect of the invention that the grab bar along the front of the vanity can be built up of laminated layers, thereby both providing a thick and strong grab bar and also stiffening the work surface generally. In FIG. 11, a three-thickness lamination is used to form a front grab bar and also to reinforce the work surface over several inches inward from the free edge 28. In this arrangement the edges of the slot 66 are rounded over by a radius R that is somewhat less that half the thickness of the laminated panel, and thus the grab bar 62 is somewhat squared in cross section, with rounded corners as shown. FIG. 11 also illustrates the preferred contouring of the upper surface of the panel to provide a lower elevation adjacent to the sink or basin, to cause water to drain back into the sink. This aspect is particular apt for basins that are brought flush to the upper surface of the panel using one of the integral attachment techniques used for simulated stone and vinyl countertop products.

It is an aspect of a preferred embodiment of the inventive technology that the associated vanity top and integral grab bar utilize solid-surface material built up or thickened at the exposed or free edge. Solid-surface material comprises a blend of natural minerals and either acrylic or polyester resin to form a usually-nonporous product. Different manufacturers of solid-surface material have specific formulations that may use different components such as different pigments that produce unique colors, patterns, and textures. With a few exceptions, solid surface is provided to fabricators in sheet form. It can be designed for use in interior and exterior applications. Layers or other shapes of the material can be joined with an inconspicuous seam and can be carved, routed, and/or sandblasted, including at the area of the seam, to shape the product and provide a surface configuration that is continuous across the seam.

The material may be supplied in standard thickness sheets of solid surface material, for example having a thickness of ½ inch (13 mm). The material is combined in a sufficient number of blocks or layers to make up the required buildup depth and/or shape. In a preferred arrangement the thickness is built up by adding layers at the underside of a top sheet, at the area to form a grab bar along the edge of the countertop. Using material that is color-matched to the top sheet, the required number of strips are cut in the required lateral width. It is important that any seams resulting from buildup of such thickness blocks or layers do not align with each other. Olanning is also required at this point to ensure that the separation between seams is a minimum of 2 inches (51 mm).

Having planned and cut out the necessary sheets or blocks, the blocks are sanded to ensure a perfectly flush face fit for all the stacked blocks or sheets, to the top sheet. An even layer of joint adhesive is applied (preferably as even and continuous a layer as possible, rather than a line or "S" pattern or similar). The joint adhesive is applied to the faces of all blocks to be seamed. Wherever the solid-surface material is to be joined to itself, the joint must be completely filled with the properadhesive so as to provide a solid junction across the seam after curing. Also, at all edge joints, all gaps must be filled with adhesive having a flexibility similar to that of the joined material, to prevent concentrating stresses into joint areas. For example, when an edge buildup is attached to the countertop with joint adhesive, all joints in the edge buildup should likewise be filled using the joint adhesive.

Having applied adhesive to the blocks or layers and placed them in abutment at the required positions, the layers (and/or blocks, etc.) are clamped together and the adhesive is allowed to cure or set. A similar operation can be used to form the buildup, to attach any required backsplash, to face any cut edges, etc.

Upon completion of attachment of all buildup layers, optionally including the attachment of covering strips over any inside and/or outside corners that are to appear as a solid body, a flush-cut trimmer is used, or a router guided along a straightedge, to finish the surfaces and edges of the buildup flush and square with the countertop.

This same flush-cut straight edge procedure is also used at the slot(s) that subdivide the grab bar(s) from the sheet. The slots can be formed and cut in a single operation using a plunge rounter. Alternatively, the slots can be formed by cutting between bore holes, optionally smoothing the cuts and attaching edge coverings, and the routing the edges smooth and rounded over as needed. Any edge imperfections are sanded smooth in this process. For routing along and smoothing edges and seams, an appropriate size carbide router bit is chosen (cylindrical for flat smoothing or radiused for rounding over), preferably ensuring that the bit is fitted with a roller bearing. A 1½-hp router or larger is preferably employed.

Routing from left to right, all edges are routed on the face side of the countertop. For correct alignment of a typical smoothed or rounded-over edge, the router must be kept level and square on the countertop. After thus routing the top edges, the countertop is turned over and the smoothing steps are repeated on the bottom edge of the buildup as required.

The formed countertop section(s) are mounted on perimeter framing supports (with added substrates). Preferably, mechanical fasteners attach to wall carriers such as ledger strips or the like. Small amounts of silicone sealant are advantageously used to render all remaining seams and attachments watertight. A drop-in/undermount basin or vanity sink can be used or a flanged basin/sink can be used. Wht the various sizing and shaping possibilities made possible, a wide range of design options are possible for placing the basin on, in or under the ½ inch (13 mm) sheet stock used for the panel beyond the built up grab bar edge.

Solid-surface materials are easy to clean and maintain using a damp cloth or sponge and mild detergent. Stubborn stains, scratches and cigarette burns may be removed by lightly sanding with a fine (180–220) grit sand paper and hand buffing the affected area with a Scotch-Brite® pad. Harsh chemicals such as stove and drain cleaners, mineral spirits, acetone, or lacquer thinner preferably are avoided.

A number of additional variations are also possible and should be apparent in view of the foregoing explanation and examples. Many of the structural aspects that are otherwise known in vanities, sinks and basins can be applied to the invention, and need not be discussed in detail. The invention is capable of application to a range of embodiments, and reference should be made to the appended claims rather than the foregoing discussion of preferred arrangements, to determine the scope of the invention in which exclusive rights are claimed.

What is claimed is:

1. A wheelchair accessible work surface, comprising:

a horizontal panel having a top surface and at least one free edge;

a mounting for supporting the horizontal panel at a space from an underlying surface and leaving clear a lateral area of said space between the underlying surface and an underside of the horizontal panel; and, a grip formed integrally in said horizontal panel, the grip being defined by at least one strip of said horizontal panel along the free edge, the grip being subdivided from the horizontal panel along the free edge by a slot extending vertically into the horizontal panel and laterally for a distance along the free edge;

wherein the horizontal panel is cantilevered from a supporting wall.

2. The wheelchair accessible work surface of claim 1, wherein the slot has a width exceeding a width of a user's fingers and wherein the slot extends vertically through the horizontal panel over said distance along the free edge.

3. The wheelchair accessible work surface of claim 1, wherein the horizontal panel comprises at least two thicknesses of material that are laminated together.

4. The work surface construction of claim 1, further comprising a basin mounted in the panel horizontal whereby the work surface forms a vanity.

5. A wheelchair accessible work surface, comprising:

a horizontal panel having a top surface and at least one free edge;

a mounting for supporting the horizontal panel at a space from an underlying surface and leaving clear a lateral area of said space between the underlying surface and an underside of the horizontal panel; and, a grip formed integrally in said horizontal panel, the grip being defined by at least one strip of said horizontal panel along the free edge, the grip being subdivided from the horizontal panel along the free edge by a slot extending vertically into the horizontal panel and laterally for a distance along the free edge;

wherein the horizontal panel is cantilevered from a cabinet extending between the panel and the underlying surface adjacent to the lateral area.

6. A wheelchair accessible work surface, comprising:

a horizontal panel having a top surface and at least one free edge;

a mounting for supporting the horizontal panel at a space from an underlying surface and leaving clear a lateral area of said space between the underlying surface and an underside of the horizontal panel;

a grip formed integrally in said horizontal panel, the grip being defined by at least one strip of said horizontal panel along the free edge, the grip being subdivided from the horizontal panel along the free edge by a slot extending vertically into the horizontal panel and laterally for a distance along the free edge; and, further comprising a basin mounted in the horizontal panel whereby the work surface forms a vanity.

7. A method for accessible use of a vanity, comprising the steps of:

providing a panel dimensioned to encompass a work surface having a lateral area bounded by an edge;

forming a slot in the panel, the slot being spaced from the edge, thereby defining a graspable structure between the slot and the edge;

mounting the panel horizontally so as to space the panel from an underlying surface, whereby a space under the panel is free for access over at least part of the lateral area;

approaching the work surface so as to pass partly under the edge into the space under the panel;

grasping the graspable structure between the slot and the edge and thereby exerting a force on the panel.

8. The method of claim 7, wherein said mounting comprises cantilevering said panel from at least one of a cabinet disposed under a part of the panel and a vertical wall disposed adjacent to the panel.

9. The method of claim 7, further comprising mounting a basin in the panel and wherein the work surface is approached for use of the basin in the panel.

10. The method of claim 7, wherein said approaching step is accomplished on a wheelchair and approaching the panel comprises bringing a lower part of the wheelchair under the panel for manual access to an upper part of the panel.

11. A work surface construction, comprising:

at least one wall panel of a building, extending upwardly from a floor of the building;

a horizontal panel having a top surface, an edge against the wall panel, and at least one free edge;

a mounting for supporting the horizontal panel at a space above the floor, and leaving clear a lateral area of said space between the floor and an underside of the horizontal panel; and, a grip formed integrally in said horizontal panel, the grip being defined by at least one strip of said horizontal panel along the free edge, the grip being subdivided from the horizontal panel along the free edge by a slot extending vertically into the horizontal panel and laterally for a distance along the free edge.

12. The work surface construction of claim 11, wherein the slot has a width exceeding a width of a user's fingers and wherein the slot extends vertically through the horizontal panel over said distance along the free edge.

13. The work surface construction of claim 11, wherein the horizontal panel comprises at least two thicknesses of material that are laminated together.

14. The work surface construction of claim 11, wherein the horizontal panel is cantilevered from the wall panel.

15. The work surface construction of claim 11, wherein the horizontal panel is cantilevered from a cabinet extending between the horizontal panel and the floor adjacent to the lateral area.

* * * * *